US007938380B2

(12) United States Patent
Becker

(10) Patent No.: US 7,938,380 B2
(45) Date of Patent: May 10, 2011

(54) COLUMN HUNG OVERHANG BRACKET FOR CONCRETE FORMING SYSTEMS

(75) Inventor: Allan James Becker, Ontario (CA)

(73) Assignee: Brand Services, LLC, Chesterfield, MO (US)

( * ) Notice: Subject to any disclaimer, the term of this patent is extended or adjusted under 35 U.S.C. 154(b) by 760 days.

(21) Appl. No.: 11/712,101

(22) Filed: Feb. 28, 2007

(65) Prior Publication Data

US 2008/0203252 A1 Aug. 28, 2008

(51) Int. Cl.

| | |
|---|---|
| ***E04G 11/24*** | (2006.01) |
| ***B66F 11/00*** | (2006.01) |
| ***B66F 3/18*** | (2006.01) |

(52) U.S. Cl. ..... 249/219.1; 249/20; 425/65

(58) Field of Classification Search ..... 249/19, 249/20, 219.1; 425/65, 63; 254/98, 103
See application file for complete search history.

(56) References Cited

U.S. PATENT DOCUMENTS

| | | | | |
|---|---|---|---|---|
| 3,843,084 | A * | 10/1974 | Gregory et al. | 248/295.11 |
| 3,863,878 | A * | 2/1975 | Gregory et al. | 248/295.11 |
| 3,900,179 | A * | 8/1975 | Mocny et al. | 248/287.1 |
| 4,040,774 | A * | 8/1977 | Scheller | 425/65 |
| 4,349,491 | A * | 9/1982 | Eyden | 264/35 |
| 4,540,150 | A * | 9/1985 | Tzincoca | 249/20 |
| 6,557,817 | B2 * | 5/2003 | Waldschmitt et al. | 249/20 |
| 6,928,782 | B2 | 8/2005 | Becker et al. | |

* cited by examiner

*Primary Examiner* — Michael Safavi
(74) *Attorney, Agent, or Firm* — Peter S. Gilster; Greensfelder, Hemker & Gale, P.C.

(57) ABSTRACT

A vertically adjustable overhang bracket uses an elongate base component adapted to be supported from a support column. A frame member is slidably secured to the base component to allow movement of the frame along the length of the elongate base component. The frame is of a shape to provide an outwardly extending support member for supporting concrete formwork members to one side of the base component. An actuator controls the position of the frame, relative to the elongate base component. With this arrangement, concrete formwork can be more easily supported in a cantilevered manner from support columns and vertically adjusted quickly to the proper position. Removal of the formwork is simplified as the frame can be lowered, relative to the base component providing clearance for removal of the bracket and the formwork.

9 Claims, 4 Drawing Sheets

COLUMN HUNG OVERHANG BRACKET FOR CONCRETE FORMING SYSTEMS

RELATED APPLICATIONS

This application claims priority benefit to Canadian patent application no. 2,579,939, filed Feb. 28, 2007, entitled "Overhang Bracket," naming Allan James Becker as inventor (referred to herein as the "'939 Canadian application"). The entire disclosure of the '939 Canadian application, including the specification and drawings, is incorporated by reference herein in its entirety.

BACKGROUND OF THE INVENTION

The present invention relates to concrete forming systems and in particular relates to an overhang bracket for use in such concrete forming systems.

In certain multi-unit building designs the concrete floor extends outwardly and beyond the column supports, such that the concrete floor includes a cantilevered or overhanging portion beyond the column supports.

U.S. Pat. No. 6,928,782 discloses a column hung bracket system for supporting a concrete form which is cantilevered or spaced outwardly of the support columns. A bracket is effectively hung from a mounting bolt on the column and the system uses the support column to support the formwork and the concrete that extends outwardly beyond the column in a cantilevered manner. In some cases the position of the mounting bolt on the column is not at the appropriate location or some adjustment in the height of the outwardly extending support member must be made to provide a finished floor at the desired level. In this case spacers or blocking can be added if the bracket is at a lower position. Such spacers allow an operator to bring the bottom surface of the concrete form to the appropriate level. If the bolt is too high the size of the support beams below the formwork that are supported by the bracket can be reduced. Onsite customized adjustment of the system is time consuming, requiring significant skill and is not cost effective.

One or more embodiments of the presently described invention provides a vertically adjustable overhang bracket that can easily accommodate changes in the desired height of the finished floor.

BRIEF SUMMARY OF THE INVENTION

A vertically adjustable overhang bracket in accordance with one or more embodiments of the present invention is for use in concrete forming and comprises an elongate base component releasably securable to a mounting bolt of a support column in a vertical orientation of the base component. The elongate base component includes a fixed mounting member extending outwardly from the elongate base component and supporting an adjustable length actuator to one side of the base component. The overhang bracket includes a frame movable along the elongate base component with the frame having a support member extending outwardly to the one side of the base component. The elongate base component and the frame include a track and slide securement there between where the frame is retained against, and supported by, the elongate base component and is moveable in the elongate direction thereof. The frame includes a member for engaging the adjustable length actuator whereby adjustment of the adjustable length actuator causes the frame to move along the elongate base component. The frame is supported in a cantilevered manner to said one side of the elongate base component with the position of the support member being adjustable in the elongate direction of the base component. The frame is lockable in an adjusted position of the frame relative to the base component for supporting of concrete loads applied to the support member during use of the overhang bracket.

According to an aspect of one or more embodiments of the invention, the actuator of the overhang bracket, in a stationary state, locks the frame in the adjusted position.

According to a further aspect one or more embodiments of the invention, the frame is a triangular-like frame with a first side of the triangular frame being parallel to the elongate base with the support member forming a second side of the triangular frame and extending outwardly from the elongate base component in a generally perpendicular manner. A third side of the frame provides a diagonal brace between the first and second sides to complete the triangular like frame.

In yet a further aspect of one or more embodiments of the invention, the fixed mounting member of the elongate base component includes an actuator mounting surface located interior to the triangular frame and the mounting plate includes a pair of connecting members secured to opposite sides of the elongate base component and extending outwardly of the elongate base component and either side of said frame to support said actuator mounting surface. The one side of the frame is moveable through a gap defined between the mounting surface and the base component.

In yet a further aspect of one or more embodiments of the invention, the actuator is a mechanical screw actuator.

In a further aspect of one or more embodiments of the invention, the actuator is a screw drive actuator.

In a preferred embodiment of one or more embodiments of the invention, the actuator is a manual actuator having a worm-gear drive.

In a further aspect of one or more embodiments of the invention, the base component includes a fixed bolt slot bracket to a side thereof opposite the frame. The fixed bolt slot bracket can be engagable with a mounting bolt of a support column to hang said overhang bracket from said support column.

In a further aspect of one or more embodiments of the invention, the base component includes an adjustable standoff member at an end of the base component opposite the fixed bolt slot bracket, said standoff member providing a support column contact point for said overhang bracket.

In a further aspect of one or more embodiments of the invention, the base component includes a pair of spaced roller support brackets with each roller support bracket having at least one roller engaging and moveable along a track portion of the frame and forming part of said track and slide securement between the elongate base component and the frame.

In yet a further aspect of one or more embodiments of the invention, each roller support bracket has at least two rollers with one roller engaging one side of the frame and the second roller engaging an opposite side of the frame.

In yet a further aspect of one or more embodiments of the invention, the first side of the frame has an I-beam construction that forms part of the track and slide securement.

BRIEF DESCRIPTION OF SEVERAL VIEWS OF THE DRAWINGS

One or more preferred embodiments of the invention are shown in the drawings, wherein.

Figure 1:
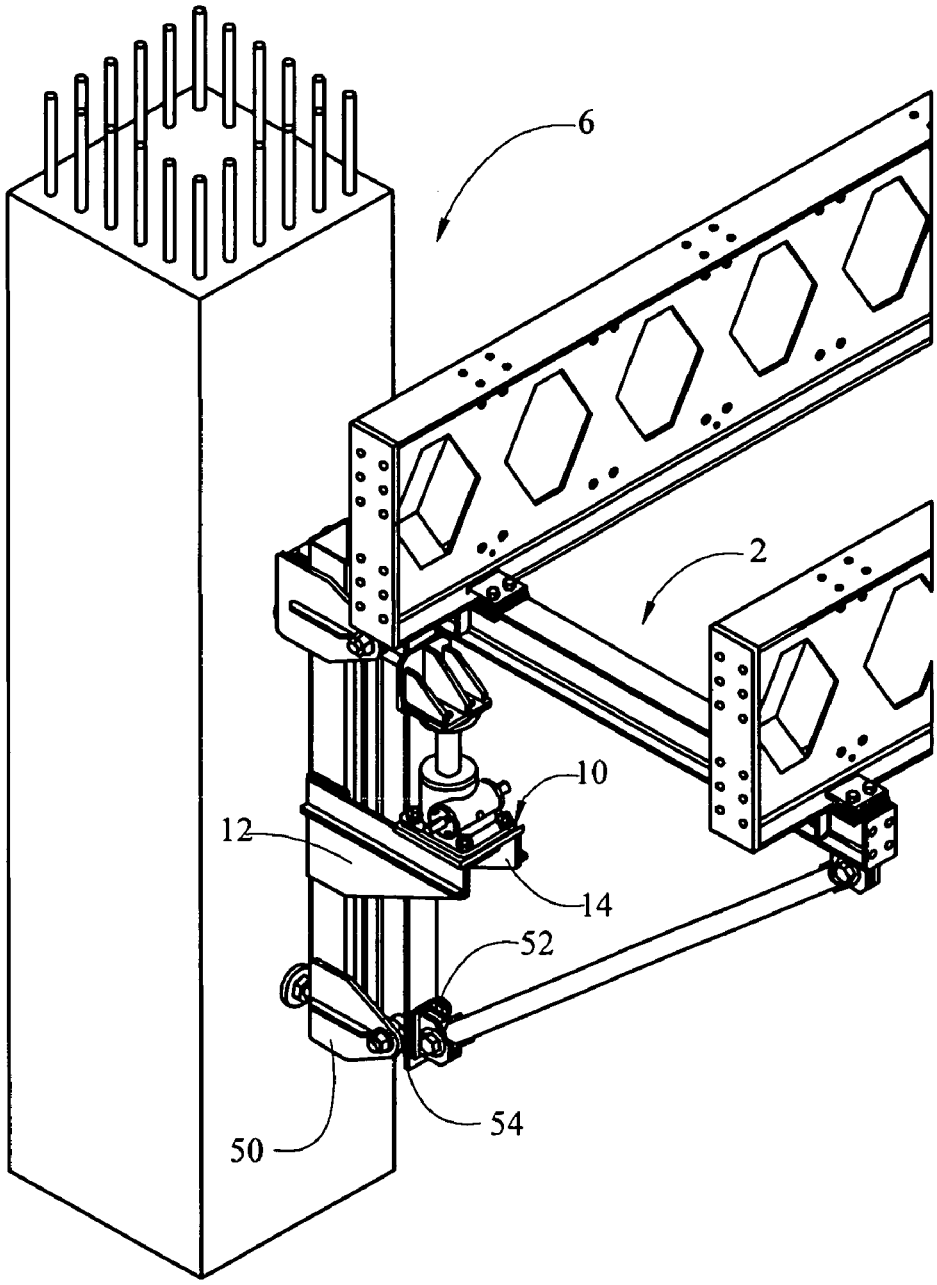
FIG. 1 illustrates a partial perspective view of the overhang bracket secured to a support column with a series of support beams secured atop the bracket in accordance with one or more embodiments of the presently described invention.

The foregoing summary, as well as the following detailed description of certain embodiments of the present invention, will be better understood when read in conjunction with the appended drawings. For the purpose of illustrating the invention, certain embodiments are shown in the drawings. It should be understood, however, that the present invention is not limited to the arrangements and instrumentality shown in the attached drawings.

DETAILED DESCRIPTION OF THE INVENTION

Figure 2:
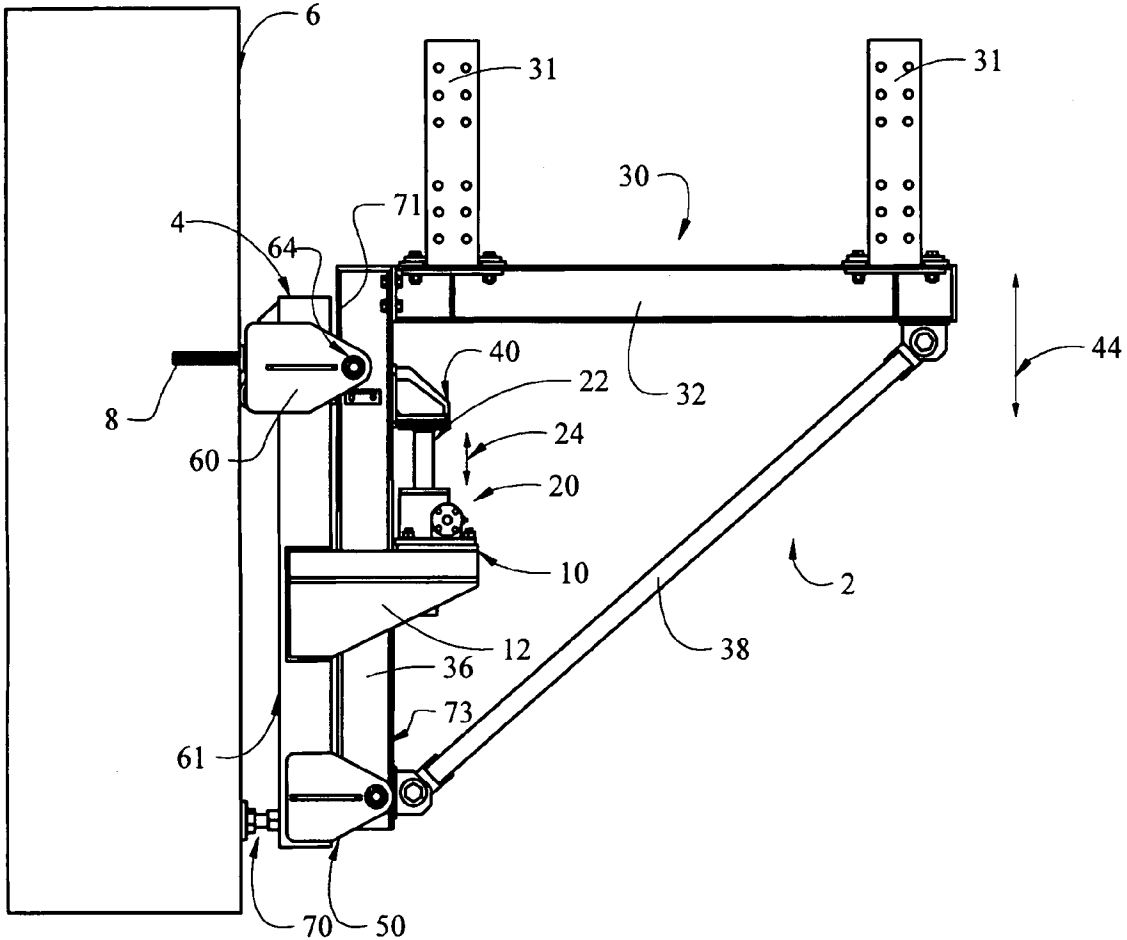
FIG. 2 is a side view of the arrangement of FIG. 1 in accordance with one or more embodiments of the presently described invention.
Figure 3:
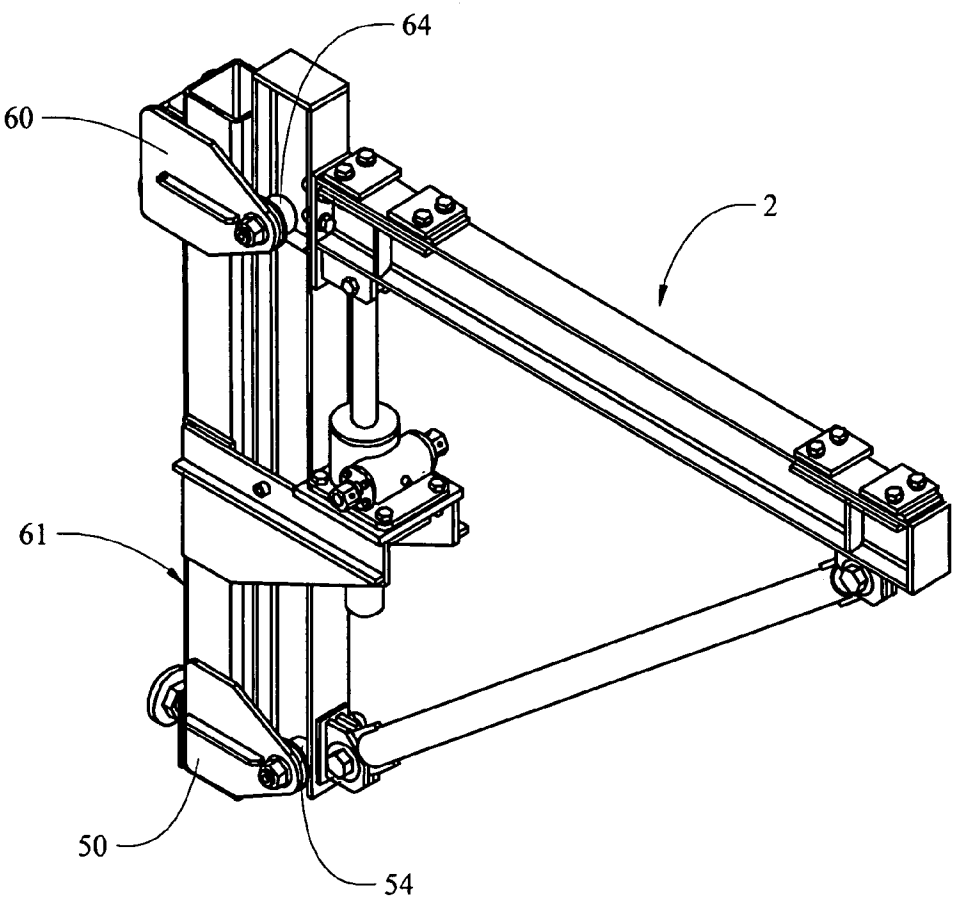
FIG. 3 is a perspective view of the overhang bracket alone in accordance with one or more embodiments of the presently described invention.

The vertically adjustable overhang bracket 2 shown in FIGS. 1, 2 and 3 includes an elongate base component 4 that can be hung or suspended from a support column 6 by means of the mounting bolt 8. The back face 61 of the elongate base component 4 includes a bolt slot 9 (see FIG. 5) for receiving the head of the mounting bolt 8 and for retaining of the elongate base component 4 to the column. A threaded adjustable standoff member or bolt 70 is provided at an end of the base component 4 opposite the bolt slot. The standoff bolt 70 allows appropriate adjustment of the elongate base component 4 from the column and also provides a bottom low transfer point.

The elongate base component 4 slidably supports the A-frame 30 having a triangular like shape. This triangular like shape is defined by a first member 36 which is of an I-beam type cross-section and is generally parallel to the elongate base component 4. Support member 32 forms the second side of the triangle and typically supports the joist or crossbeam members 31 that will support the concrete formwork. Member 38 forms the third side of the triangle and acts as a diagonal brace between the support member 32 and the first side 36.

Figure 5:
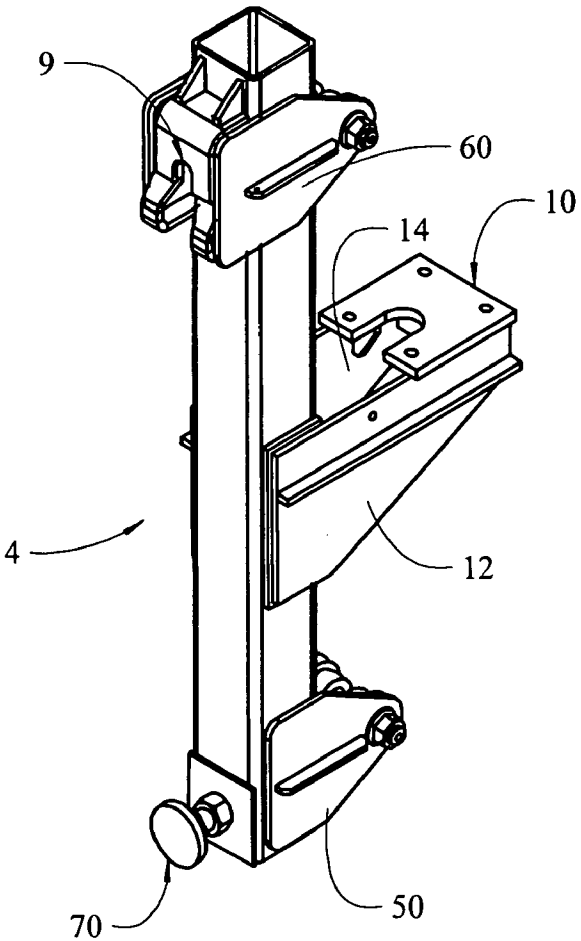
FIG. 5 is a rear perspective view of the elongate component in accordance with one or more embodiments of the presently described invention.
Figure 4:
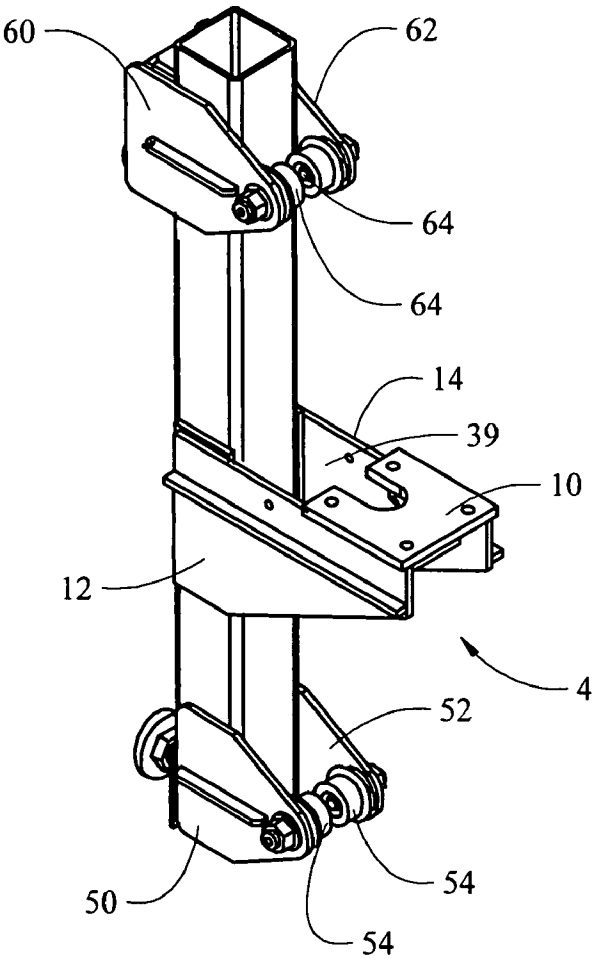
FIG. 4 is a front perspective view of the elongate base component in accordance with one or more embodiments of the presently described invention.

The elongate base component 4 as shown in FIGS. 4 and 5 includes a pair of rollers 64 positioned either side of the I-beam section of the first component 36 (FIG. 2) and in engagement with the interior surface of an outer flange 71 of the I-beam. One of the rollers 64 is supported by triangular bracket 60 secured to the base component 4 and the other roller 64 is supported by triangular bracket 62 secured to the base component 4. The base component 4 also includes a second pair of rollers 54 engaging with the interior surface of the interior flange 73 of the I-beam section. One of the rollers 54 is supported by triangular bracket 50 secured to one side of the base component 4 and the other roller 54 is secured to triangular bracket 52 secured to the opposite side of base component 4. The base component 4 and the I-beam 36 have a track and slide securement arrangement. The I-beam 36 can move vertically as indicated by 24 and 44 in FIG. 2. The rollers 54 and 64 assist in defining this track and slide securement arrangement. Rollers 54 engage flange 73 of the I-beam 36 and rollers 64 engage the flange 71 of the I-beam.

In order to fix the position of the A-frame 30 relative to the base component 4 an adjustable length actuator 20 is provided having a connecting member 22. The actuator 20 is mounted on the fixed mounting plate 10 supported outwardly from the base component 4 but in a fixed relationship thereto by means of the connecting members 12 and 14 provided either side of the base component 4. A gap 39 is provided between the fixed mounting plate 10 and the elongate base component 4 that receives the first side 36 of the A-frame 30. Thus the A-frame 30 is moveable in the length of the elongate base component 4. The connecting rod 22 is in engagement with the fixed actuator bracket 40 secured to the first component 36. Adjustment of the length of the actuator as indicated by 24 will move the A-frame 30 in a vertical direction relative to the base component 4. In this way the support members 31 can be adjusted vertically relative to the support column 6.

The vertically adjustable overhang bracket 2, by control of the actuator 20, allows adjustment of the level of the support members 31 relative to the column 6. This provides a simpler mechanism for adjusting the level of the formwork by means of the actuator 20. The support members 31 are supported by two or more overhang brackets 2 secured to different columns and these brackets are adjusted in height to define the correct height for the formwork that overhangs the support column 6.

The actuator 20 preferably is a manually driven actuator but can be powered if desired. Preferably the actuator includes a worm-gear drive whereby adjustment of the actuator is accomplished by rotation of the worm-gear drive and the worm-gear drive effectively locks the A-frame in position if the drive is in a stationary or non-driven state. Other arrangements for the actuator can be provided but it is desirable and convenient that the actuator controls the movement of the frame 30, and also provides a lock withstanding the various load forces that are applied to the overhang bracket during use. Other arrangements for providing an adjustable length member between the A-frame and the base component 4 can be used.

It can also be appreciated that a separate locking arrangement can be provided by means of suitable lock bolts or lock pins. Other mechanical locking arrangements can be used that are separate and distinct from the actual actuator. Such additional locking mechanisms can allow the capacity of the actual actuating mechanism to be reduced in that the live concrete load would be withstood by a separate member rather than the actuator. Actuators that are capable of withstanding these types of forces and effectively also form the lock can easily be specified. A number of these actuators are offered by the company "Duff-Norton" and many of these actuators are screw actuator models. Some of these actuators include a worm-gear drive arrangement. These actuators provide improved adjustability and are designed to withstand the construction environment. The adjustable actuator also allows simpler removal of the overhang bracket. The "A" frame can be lowered to allow sufficient clearance, and without unnecessary dismantling of the support beams, etc., if desired.

It has been found that this particular overhang bracket with the vertical adjustability reduces the time required for set up of concrete formwork involving overhanging floors and also provides a system that is more convenient to adjust.

Although various preferred embodiments of the present invention have been described herein in detail, it will be appreciated by those skilled in the art that variations may be made thereto without departing from the spirit of the invention or the scope of the appended claims.

What is claimed is:

1. A vertically adjustable overhang bracket for use in concrete forming comprising an elongate base component releasably securable to a mounting surface of a support column in a vertical orientation of the base component, said elongate base component including a fixed mounting member extending outwardly from said elongate base component and supporting an adjustable length actuator at a spaced distance to one side of said base component, said overhang bracket including a triangular frame movable along the elongate base component with said triangular frame having a support member extending outwardly to one side of and beyond said elongate base, said elongate base component and said frame including a track and slide securement where said triangular frame is retained against and supported by said elongate base component and movable in the elongate direction of said base component with said fixed mounting member supporting said adjustable length actuator within said triangular frame, said triangular frame including a member for engaging said adjustable length actuator with adjustment of said adjustable length actuator to extend or retract causing said frame to move along said elongate base component, said triangular frame being supported in a cantilevered manner to one side of said elongate base component with the position of the support member being adjustable in the elongate direction of said base component and lockable for supporting of concrete loads applied to said support member during use of said overhang bracket as determined by said adjustable length actuator;

said triangular frame including a first side being parallel to said elongate base component, said support member forming a second side of said triangular frame and extending outwardly from said elongate base component in a perpendicular manner, and a third side of said frame providing a diagonal brace between said first and second sides to complete said triangular frame; and wherein said fixed mounting member includes an actuator mounting plate located interior to said triangular frame and said actuator mounting plate includes a pair of connecting members secured to opposite sides of said elongate base component and extending outwardly of said elongate base component and either side of said frame to support said actuator mounting plate, said first side of said frame being movable through a gap defined between said mounting plate and said base component.

2. An overhang bracket as claimed in claim 1 wherein said actuator is a mechanical screw actuator.

3. An overhang bracket as claimed in claim 1 wherein said actuator is a motorized screw drive actuator.

4. An overhang bracket as claimed in claim 1 wherein said actuator is a manual actuator having a worm gear drive.

5. An overhang bracket as claimed in claim 1 wherein said base component includes a fixed bolt slot bracket on a side of said base component opposite said frame, said fixed bolt slot bracket allowing said overhang bracket to be hung from a mounting bolt of a support column that forms the mounting surface of the support column.

6. An overhang bracket as claimed in claim 5 wherein said base component includes an adjustable standoff member at an end of said base component opposite said fixed bolt slot bracket.

7. An overhang bracket as claimed in claim 1 wherein said base component includes a pair of spaced roller support brackets with each roller support bracket having at least one roller engaging and movable along a track portion of said frame.

8. An overhang bracket as claimed in claim 7 wherein each roller support bracket has at least two rollers with one roller engaging one side of said frame and the second roller engaging an opposite side of said frame.

9. An overhang bracket as claimed in claim 8 wherein said first side of said frame has an I-beam cross section that forms part of said track and slide securement.

* * * * *